US005827012A

United States Patent [19]

Circeo, Jr.

[11] Patent Number: 5,827,012

[45] Date of Patent: Oct. 27, 1998

[54] THERMAL PLASMA CONVERSION OF LOCAL SOILS INTO CONSTRUCTION MATERIALS

[76] Inventor: Louis J. Circeo, Jr., 4245 Navajo Trail, Atlanta, Ga. 30319

[21] Appl. No.: 778,603

[22] Filed: Jan. 6, 1997

[51] Int. Cl.[6] ..... E02D 19/14; F23G 5/00

[52] U.S. Cl. ..... 405/131; 110/346; 110/246; 405/128; 405/258

[58] Field of Search ..... 405/128, 131, 405/258; 110/346, 246; 588/252, 249

[56] References Cited

U.S. PATENT DOCUMENTS

| | | | |
|---|---|---|---|
| 2,950,566 | 8/1960 | Henry | 47/1 |
| 4,751,887 | 6/1988 | Terry et al. | 110/246 X |
| 4,776,409 | 10/1988 | Manchak | 405/128 X |
| 4,890,563 | 1/1990 | White et al. | 110/246 |
| 4,993,331 | 2/1991 | White et al. | 110/246 |
| 4,998,486 | 3/1991 | Dighe et al. | 110/346 |
| 5,005,494 | 4/1991 | Schlienger | 110/246 X |
| 5,020,452 | 6/1991 | Rybak | 110/346 X |
| 5,054,406 | 10/1991 | Judd | 110/246 |
| 5,138,959 | 8/1992 | Kulkarni | 110/346 |
| 5,176,445 | 1/1993 | Mize | 47/1.42 X |
| 5,265,977 | 11/1993 | Weirich et al. | 405/128 |
| 5,350,252 | 9/1994 | Musil et al. | 405/128 |
| 5,408,494 | 4/1995 | Schlienger | 110/316 X |
| 5,410,121 | 4/1995 | Schlienger | 110/346 X |
| 5,634,414 | 6/1997 | Camacho | 110/346 |

FOREIGN PATENT DOCUMENTS

| | | | |
|---|---|---|---|
| 00481444A | 4/1992 | European Pat. Off. | 588/252 |

*Primary Examiner*—Dennis L. Taylor
*Attorney, Agent, or Firm*—Olive & Olive, P.A.

[57] ABSTRACT

A plasma arc torch heat based apparatus and method converts a quantity of particulate soil having a first set of engineering properties into a selected number of smaller quantities each having improved engineering properties differing from the first set of engineering properties and makes practical utilization of the smaller quantities for applications in which the first set of engineering properties were not suited. The apparatus includes a rotatable kiln which is positionable at an angle to horizontal such that soil is received in an upper end and discharged at a lower end thereof. The kiln is heated to a controlled temperature based on the properties of the soil before treatment and the desired improved properties after treatment to meet application requirements.

10 Claims, 3 Drawing Sheets

THERMAL PLASMA CONVERSION OF LOCAL SOILS INTO CONSTRUCTION MATERIALS

FIELD OF THE INVENTION

This invention relates generally to methods and apparatus for improving the engineering properties of local soils through thermal treatment and more specifically to methods and apparatus for improving the engineering properties of local soils with a plasma arc torch heating system to create construction materials on or near the construction site.

BACKGROUND OF THE INVENTION

Three related and later referred to United States patents provide useful background for the present application, namely U.S. Pat. No. 5,181,797, issued Jan. 26, 1993, entitled "In-Situ Soil Stabilization Method and Apparatus"; U.S. Pat. No. 5,181,795, issued Jan. 26, 1993, entitled "In-Situ Landfill Pyrolysis, Remediation and Vitrification"; and U.S. Pat. No. 5,276,253, issued Jan. 4, 1994, entitled "In-Situ Remediation and Vitrification of Contaminated Soils, Deposits and Buried Materials", the teaching of each of which are incorporated herein by reference.

The problem addressed by the present invention concerns strengthening local earthen materials by improving their load bearing characteristics and other engineering properties. The terms "soil", "earth", and "rock" are sometimes used interchangeably. However, how each relate to the invention will become readily apparent. Soft or unstable soil and rock are of concern primarily in the areas of foundations for buildings, bridges, roads, airfields, and similar structures. Such materials, once improved, also can be used as a substitute for aggregate or sand in the production of concrete, asphalt and other building and pavement materials on or near the construction site.

It often occurs that a construction project, be it a building, a bridge or another structure is intended to be placed on land which is made up of unstable, or weak, foundation soil. The instability may be the result of inadequate compressive strength or shear strength of the surface soil, the result of soil subject to excess settlement, the result of an otherwise firm surface layer which exhibits high shrink-swell characteristics or the result of a firm surface layer residing over a soft or unstable underlayer. These conditions may be due, in some circumstances, to land which has been built up as a result of waste deposits such as landfills, sludge beds, mine tailings or earth dredged from under a body of water. Many weak soils cannot economically be improved according to known technology and must, at great expense, be excavated and replaced with stable foundation materials.

Several methods have been devised over the years to compensate for unfavorable soil conditions of the type described above. Prominent among these methods has been the practice of driving load supporting piles into the ground. However, many earthen materials cannot be adequately stabilized with driven piles. Another traditional solution for supporting a load on soft surface soil has been that of utilizing a "floating" foundation. Floating is accomplished by excavating a hole that is larger than the proposed building base and constructing a greatly oversized foundation. By effectively spreading the weight being supported over a large area, the tendency to settle is reduced. The floating foundation method requires an expenditure of considerable material. Furthermore, it is not always feasible to extend the dimensions of a foundation because of lack of available land or because of unsuitable topography.

In the distant past, soil excavated from a particular site was sometimes heat treated by combustion of fossil fuels in processing ovens and returned to the same site in a more stable condition. A second method of foundation soil stabilization is known in the construction industry as in-situ thermal hardening with fossil fuels. To accomplish this thermal hardening, a hole is drilled in the soil and the earth surrounding the hole is heated by gas, oil or coal fuel, so as to first drive off the moisture and later cure the soil to a tubular pile of brick-like hardness. This method is best suited to clay or loess-based soils and tends to be very slow. A thermally hardened tubular pile by in-situ thermal hardening with a fossil fuel sometimes requires several weeks to be formed. This procedure is not considered economically viable today.

Most construction operations require satisfactory aggregate and sand materials for concrete, asphalt or concrete/asphalt mixes and other hardened materials such as soil-cement mixtures. In many regions there is a dearth of these materials, which requires their importation over great distances and at great cost. So far as applicant is aware, there is no satisfactory technology or technique which enables locally available unsuitable soils or rocks to be processed and used as a substitute for the type of mix materials referred to above. When a construction project is required to be performed in a catastrophic disaster situation, as part of a military operation on the battlefield or in a remote area, time may be a critical factor in completing the construction project. In these situations, the ability to rapidly improve the engineering properties of locally available soil and certain forms of rock such that the soil and rock, once improved, can adequately perform as a foundation material or a substitute material in concrete and asphalt mixes could be an overriding priority for construction operations in the type of situations described.

Recognition is given to the fact that it has been known to sterilize soil by passing the soil through a trailer-mounted drum and contacting the soil either with superheated steam at 500° F. as described in U.S. Pat. No. 2,563,926 or with a flame as described in U.S. Pat. No. 2,858,755, the teachings of both of which patents are incorporated herein by reference. In another known practice, soil is passed through a trailer-mounted drum externally heated by gasoline burners as described in U.S. Pat. No. 968,772, the teachings of which are also incorporated herein by reference. Thus, while it has been known to apply heat to soil to remove or destroy selected undesirable constituents in a local, primarily organic soil, the prior art has not recognized the possibility of being able to convert, by use of heat, a large quantity of a local primarily inorganic soil into one or more construction materials each having improved engineering properties suited to particular applications for which the original large quantity of local soil was not suited. More specifically, while the prior art has taught the use of relatively low temperature heat to destroy organisms, weeds, grass and similar materials in a soil without destroying the integrity or utility of the soil for agricultural purposes, the prior art has not taught the use of relatively high temperature to improve the engineering properties of inorganic soils so as to make the soil particularly suited for a wide range of specified construction purposes.

The invention disclosed herein recognizes that locally available soil and certain forms of rock material could be improved for use in construction both by the application of very high quantities of heat energy and by applying such heat energy at substantially higher temperatures than previously known. The invention also recognizes that a basic and relatively new tool for producing such a high quantity of heat energy and high temperature is the plasma arc torch. Plasma arc torches can routinely operate at temperatures of 4,000° C. to 7,000° C. and in the range of 85–93% electric to heat energy efficiency. The highest temperature attainable by a fossil fuel combustion source, by way of comparison, is in the vicinity of 2,700° C. The invention also recognizes that the plasma arc torch opens up the possibility of heating a selected soil up to a range of temperatures varying from the soil's drying temperature to its melting and vitrification temperature.

A plasma arc torch, used by way of example as a preferred source of heat, operates by causing a high energy electric arc to form across a stream of plasma, or ionized gas, generating large amounts of heat energy. As can be readily discovered from both the trade literature and prior patents, there are many types of plasma arc torches, and U.S. Pat. No. 5,362,939, which describes a particular type of plasma arc torch, is cited by way of illustration, the teachings of which are incorporated herein by reference. A plasma arc torch can operate on AC or DC power, use inert, reducing or oxidizing gas, and have metal or graphite electrodes which may be solid or hollow. All plasma arc torches generally fall into one of two basic categories according to the arc configuration relative to the torch electrodes, i.e., transferred arc type and non-transferred arc type. The arc of a transferred plasma arc torch is formed by and jumps from a single electrode on the torch, through the gas, and to an external electrode which is connected to an opposite electrical pole. The arc of a non-transferred plasma arc torch is formed by and jumps from one electrode on the torch across the plasma gas to another electrode on the torch. In a plasma arc torch, the heat energy produced is proportional to the length of the arc, assuming an identical plasma gas at a uniform flow rate and a constant applied electrical current.

While a plasma arc torch is described as the preferred source of heat, it is recognized that other sources of plasma heating could also be employed. For example, the induction coupled plasma torch recently announced by Plasma Technology, Inc. of Santa Fe, N. Mex., is indicated to be acceptable as a plasma heating source.

The invention also recognizes that various levels of temperature and heat energy can be obtained with a plasma arc torch by varying the type of plasma gas, the gas flow rate, the arc voltage, and the mode of operation. This capability, combined with a specified residence time in the kiln, will heat the soil to the proper temperature required to create the desired improvements in the engineering properties of the soil. Thus, the invention recognizes that the kind and degree of soil improvement can be regulated according to the need and that quantities of soil having different engineering properties can be derived from a common soil having weaker engineering properties.

Since the present invention in the embodiment being described makes use of a plasma arc torch, reference is next made to previously referred to U.S. Pat. Nos. 5,181,797 and 5,276,253. The '797 patent teaches the use of a plasma arc torch to operate in subterranean boreholes to melt and vitrify an in-situ column of unstable soil or rock in order to strengthen and improve the foundation material at that location. The method of the '797 patent involves lowering a plasma arc torch into a borehole and using the torch to create heat in the weak and unstable foundation material. The heat is used to improve the engineering properties in the soil medium by vitrifying the soil into a rock-like column adjacent to the borehole and out to a selected radial distance from the borehole, based on the power level of the plasma arc torch and the withdrawal rate from the borehole. Also to be noted for further background is that the method of the '797 patent also identifies concentric zones of improved foundation material at greater radial distances where thermal conduction from the plasma heating and vitrified zone creates brick-like material close-in, and further out creates material which exhibits significantly reduced plasticity characteristics, resulting in greatly improved engineering properties. The '253 patent teaches the use of a plasma arc torch operating in-situ in boreholes for the treatment of soils contaminated with hazardous materials at or beneath the surface of the earth.

In another aspect of the prior art, the invention recognizes that in highway, airport runway and other forms of construction, it is often the practice to build upon a compacted subgrade, layers of incrementally higher strength soil materials, which are included within a subbase course and a base course. These various layers may in turn be required, or desired, to have different engineering properties even though the materials having such properties are often not readily available. The ability to be able to convert a large quantity of a local soil into lesser quantities and with each lesser quantity having specific engineering properties suited to a particular application such as for a flexible pavement subbase course is thus a need recognized and dealt with by the present invention. The book *"Principles of PavementDesign"* (1959) by E. J. Yoder, published by John Wiley and Sons, Inc., may be referred to for more useful background relating to the need in flexible pavement construction for materials having different engineering properties.

Having described the background art, the description next provides a summary of the invention and is followed by a more detailed description of the invention from which the differences between the method and apparatus of the invention and the prior art practices will become readily apparent.

SUMMARY OF THE INVENTION

The invention disclosed relates to a unique method and apparatus for the improvement of weak, unstable, soft earth, soil and rock by use of a plasma arc torch heated atmosphere as applied to either soil intended for use as a foundation material or of improved soil or rock-like materials to support construction such as their utilization as substitutes for natural materials in concrete or asphalt mixtures and the like. The invention recognizes that by employing the extremely high and readily controllable temperatures and thus the relatively high heat energy achievable with a plasma arc torch, it becomes possible to heat earthen materials across a complete spectrum of temperature ranges, up to and including melting temperatures, to thermally stabilize rock and soil and to create various levels of strengthening in the formerly weak soil or rock materials. The invention method and apparatus are directed to either an application in which the purpose is to improve foundation soil on which some form of construction is to be supported or to an application in which the improved materials can be used as a substitute for sand and aggregate components in hardened mixtures such as concrete and asphalt. The soil materials processed by the invention are generally in a particulate form, but may be broken up or crushed both at the beginning and at the end of the invention process by clod breakers, crushers or the like.

Generally and as recognized by the invention, when soil is heated above 200° C., irreversible improvements in the engineering properties take place. In particular, there occurs a decrease in water sensitivity which reduces swelling, compressibility, and plasticity; there are also increases in compressive and/or shear strength, resulting in a strengthened soil mass. Above 500° C., soil plasticity is reduced effectively to zero. At about 900° C., the soil begins to solidify into a brick-like material. Finally, the soil melts at temperatures over 1,100° C. and becomes fused into a hardened, vitrified mass upon cooling, with physical properties equivalent to a strong, dense rock and having a specific gravity up to the range of 4.25. The invention recognizes and takes advantage of the fact that all the aforementioned soil improvements could qualify as an improved construction material in specific construction zones, i.e., from reduction in plasticity in soils requiring only small strength improvement, to the transformation of soil into vitrified material to create a rock-like foundation or for use as an aggregate in a concrete or asphalt mixture requiring significant compressive and shear strength properties. The invention disclosed further recognizes that similar significant improvements in the engineering properties may be obtained in the case of weak and disintegrated rock formations, and in unconventional foundation materials, such as found in landfills, in dredged materials, in mine tailings, etc. Selected contaminated soils may also be processed to achieve both remediation of the soil and improved engineering properties for beneficial use in a construction project.

In the embodiment being used by way of illustration, the method and apparatus of the invention utilize a mobile rotating soil thermal conversion kiln heated with a plasma arc torch. The kiln is loaded continuously with weak, locally available, earthen and typically at least partially particulate materials on or near a construction site. The earthen material being processed may be passed through a clod breaker or the like to permit more uniform thermal heating throughout the soil particles being processed. The soil should remain in the kiln long enough for all particles throughout the soil mass to reach the minimum temperature predetermined to achieve the desired amount of improvement. At that time, the engineering properties of the entire soil mass will be permanently improved at least to the extent required for its specific construction application. Thereafter, the soil does not have to remain in the kiln and may be discharged.

Several variables associated with the invention method can be adjusted in order to heat the soil to a prescribed temperature level, and thereby achieve a specific improvement in the strength of the soil. These variables may include, by way of example, the soil feed rate, the plasma arc torch power level, the type of gas fed to the plasma arc torch, the speed of kiln rotation, the tilt angle of the kiln, and the residence time in the kiln. The end result of the invention method will thus be an output of different quantities of foundation soil or aggregate material whose respective engineering properties have been improved to prescribed levels appropriate to its planned use.

The invention recognizes by way of further example that a weak expansive clay at a road construction project, which would otherwise have to be excavated and replaced, may be heated to 500° C. to reduce its plasticity to zero, permitting it to be used in the road foundation as a subbase material. Later in the road construction project, this same weak clay material may be heated to 900° C. to turn it into a brick-like material which, when crushed, can be used as a substitute for sand. Ultimately, the clay could be heated to above 1,100° C. to melt it and create a rock-like material for use as a base course material or as an aggregate in a concrete or asphalt pavement mix. Obviously, the lower the soil temperature requirements, the greater throughput of improved soil from the kiln, resulting in significant reductions in the unit cost of soil improvement. Thus, by use of the invention method, a range of thermal plasma soil improvement options for a specific construction project can be examined and compared with other procurement opportunities and technologies in order to select the most economical ground improvement solutions.

DESCRIPTION OF THE PREFERRED EMBODIMENT

Figure 1:
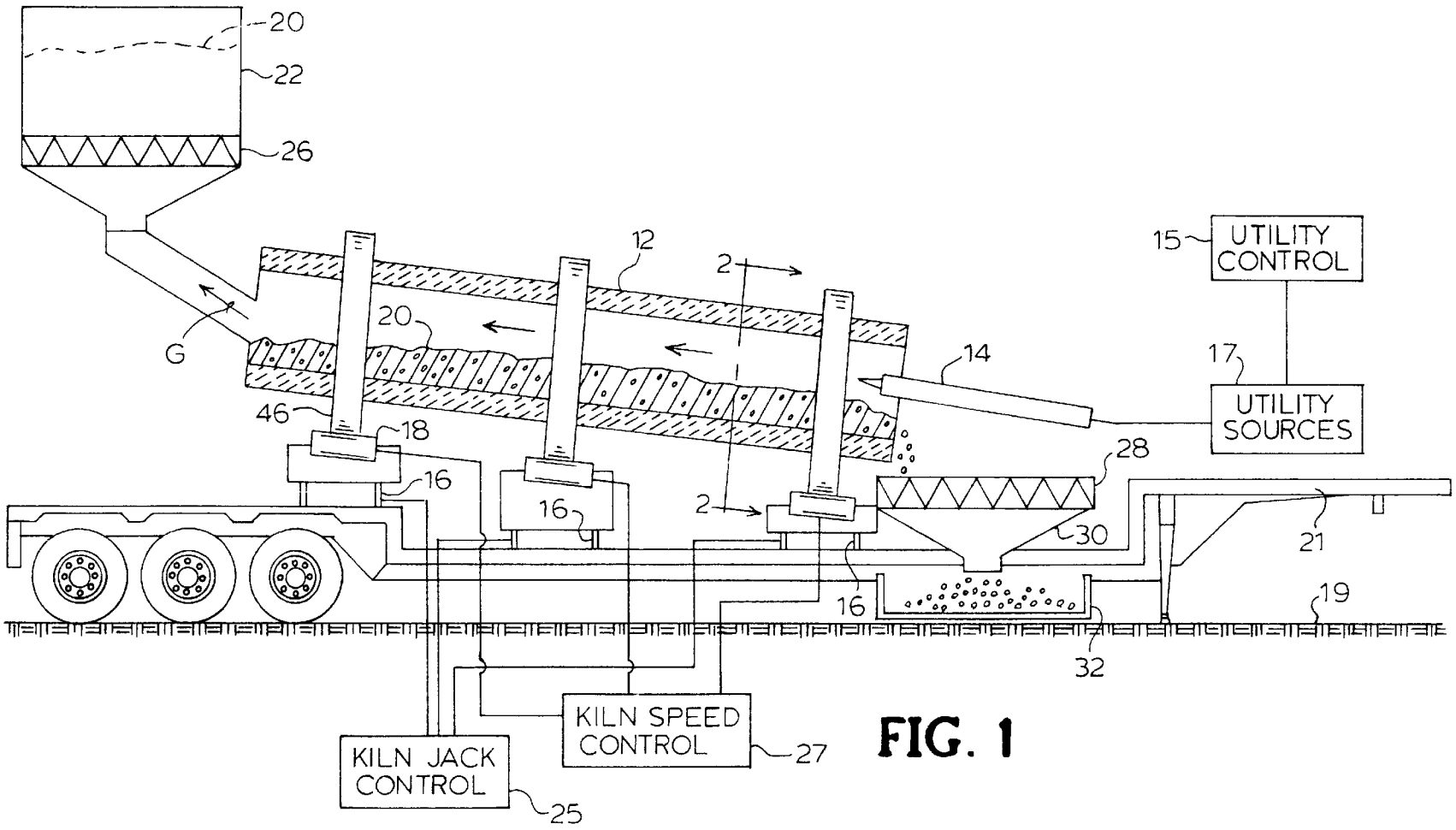
FIG. 1 is a schematic elevation view of a mobile, rotating soil conversion kiln incorporating a plasma arc torch and various operating features designed to create the required soil improvement characteristics according to the invention, with a drum shown in cross section for clarity and the fins shown in FIG. 2 being eliminated in FIG. 1 for purposes of simplifying the drawing.

In the description to follow and as previously mentioned, the terms "rock", "soil", and "earth" are periodically interchanged, it being recognized that soil or earth as commonly understood is essentially disintegrated or finely ground rock. The processing of unconventional foundation materials such as those associated with landfills, dredged materials and mine tailings should also be considered within the purview of the invention. In addition, it is also recognized that a selected contaminated soil which may be present on or near a construction site may be processed with the method and apparatus of the invention in order to treat and remediate the soil and at the same time convert the soil to an improved condition for use in a construction project at the site.

As described earlier, when a weak soil (particularly a clay soil) is heated to temperatures above 200° C., significant improvements in the engineering properties of the soil begin to occur. Interstitial water is driven off in an irreversible reaction which begins to reduce the plasticity and the shrink-swell characteristics of the soil. At temperatures approaching 500° C., the soil becomes non-plastic which greatly enhances its utility as a foundation material. The soil begins to take on brick-like qualities at temperatures above 900° C. Soil melting begins at temperatures exceeding 1,100° C., with the resulting rock-like material routinely exhibiting compressive strengths above 15,000 psi, which is several times greater than unreinforced concrete. Because of wide variations in soil constituents, temperatures at which improvements in engineering properties take place may vary considerably. Therefore, the above temperature limits should be considered as representative. Candidate soils intended to be processed by the method of the invention may be readily tested in a laboratory in order to determine how their stabilization characteristics and engineering properties change when exposed to a range of temperatures from drying to melting and vitrification.

The gradual and steady improvement in engineering properties resulting from this ability to heat soil to any selected temperature up to its melting stage thus provides construction operations with a wide range of soil improvement options with virtually any soil material. This flexibility permits soil specifications to be customized to meet prescribed strength requirements. For example, each one-foot soil layer of a foundation design can be specified and made to conform to specific engineering properties, and therefore in order to achieve these properties can be heated to a specific temperature. This capability thus results in an economical foundation thermal stabilization plan by permitting the soil strength to be less in the lower depths of a foundation. Furthermore, the time required to convert local soils into lower strength construction materials will be reduced considerably, greatly increasing the throughput of the soil improvement process. Thus the construction project could be completed more expeditiously.

As another example of how the invention may be applied, it is noted that a military operation on a battlefield or in a remote location may not have access to conventional equipment and construction materials required for timely construction operations, particularly for vehicle trafficability and mobility over cross-country terrain. The capability to rapidly convert virtually any local soil into a satisfactory construction material by the invention method thus may provide an important determinant in the success of a military operation. In another example, construction operations in areas devastated by natural or man-made disasters, such as earthquakes, where routine construction materials cannot be readily transported to a construction site, may now take beneficial advantage of the teachings of the invention.

Based upon the recognized physical characteristics of soil as described and upon what is believed to be a novel use of plasma arc torches, the disclosure that follows describes a specific embodiment as exemplary of the invention. As next explained, the embodiment described is based on use of a rotary kiln heated with a plasma arc torch schematically illustrated as being supplied by appropriate utility sources 17, i.e. plasma gas, water and power, and equipped with a conventional utility control 15 which enable the heat and thus the internal kiln temperature to be adjusted. The soil to be processed is fed into one adjustably elevated end of the kiln and discharged out of the opposite lower end as an improved construction material with properties dependent on the temperature to which the soil was heated while in the kiln. The tilt of the kiln is adjustable to control the rate of flow of material though the kiln and thus the residence time as somewhat schematically illustrated in FIG. 1. Under an ideal situation, the internal kiln temperature is maintained at a constant relatively high temperature. Thus, the residence time of the soil in the kiln becomes the principal variable factor in achieving the desired improved soil engineering properties.

Making reference to the illustrative embodiment of the invention, FIG. 1 illustrates in a schematic elevation view, a mobile, rotating kiln 12 and associated apparatus for supporting and driving kiln 12 as it is mounted on a trailer 21, supported on roadway 19, as required for a complete thermal plasma soil improvement process according to the invention. The specific dimensions assigned to apparatus will vary since the size of kiln 12 will be directly dependent upon the power level of plasma arc torch 14 used in the process. Typically a 1 megawatt plasma arc torch 14 will require a kiln 12 with an inside diameter of approximately five feet, while a 500 kilowatt torch 14 will require a minimum inside diameter of about three feet. The length of kiln 12 (typically 20 feet long for a 1 megawatt torch) will also be dictated by the range of residence times considered appropriate for the specific soil improvement application. Rotating kiln 12 has the ability to be positioned at an angle of a few degrees up to an angle of approximately 20 degrees from horizontal through the actuation of jacks 16 by a suitable control 25. This range of angles permits the soil residence time in the kiln to be regulated considerably. Kiln 12 preferably has a capability to rotate 1–5 revolutions per minute on rollers 18. The exhaust gas G from kiln 12 is passed through the untreated soil 20 in the feeder hopper 22 to preheat the soil. A clod breaker 26 is located at the base of the feeder hopper 22 to break up large lumps of soil before entering kiln 12 and to control the feed rate of the soil to the kiln 12. A similar clod breaker 28 is located in a discharge hopper 30 to break up fused clods of treated soil. A side discharge system 32 is designed to empty the improved soil into a carrier alongside the mobile system, or to allow it to fall directly on the ground surface. Vitrified soil exhibiting high strength characteristics may require additional processing through a rock crusher in order to break it into proper size pieces for its planned use in the construction project.

Figure 2:
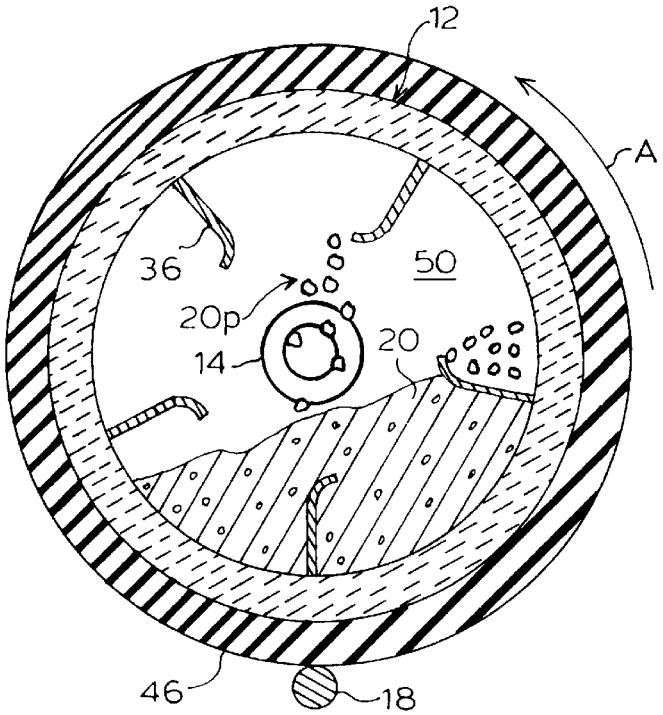
FIG. 2 is a schematic cross section view taken in the direction of line 2—2 of FIG. 1 showing the internal fins of the FIG. 1 kiln which assist in heating the soil quickly and uniformly during its residence time in the kiln.

FIG. 2 is an enlarged cross section of the plasma heated soil improvement kiln 12. Kiln 12 comprises an open cylinder containing a series of metal fins 36 which help to agitate soil 20 and carry soil particles 20*p* close to the top of the kiln diameter before the soil tumbles through the hot plasma-heated gas stream. Kiln 12 is lined by a suitable refractory material. Kiln 12 rotates in the direction indicated by arrow A by means of driven rollers 18 engaging peripheral rims 46. The soil particles 20*p* drop through the hot gas space 50. The speed of rollers 18 and thus the speed of kiln 12, is controlled by a suitable kiln speed control 27 (FIG. 1).

Figure 3:
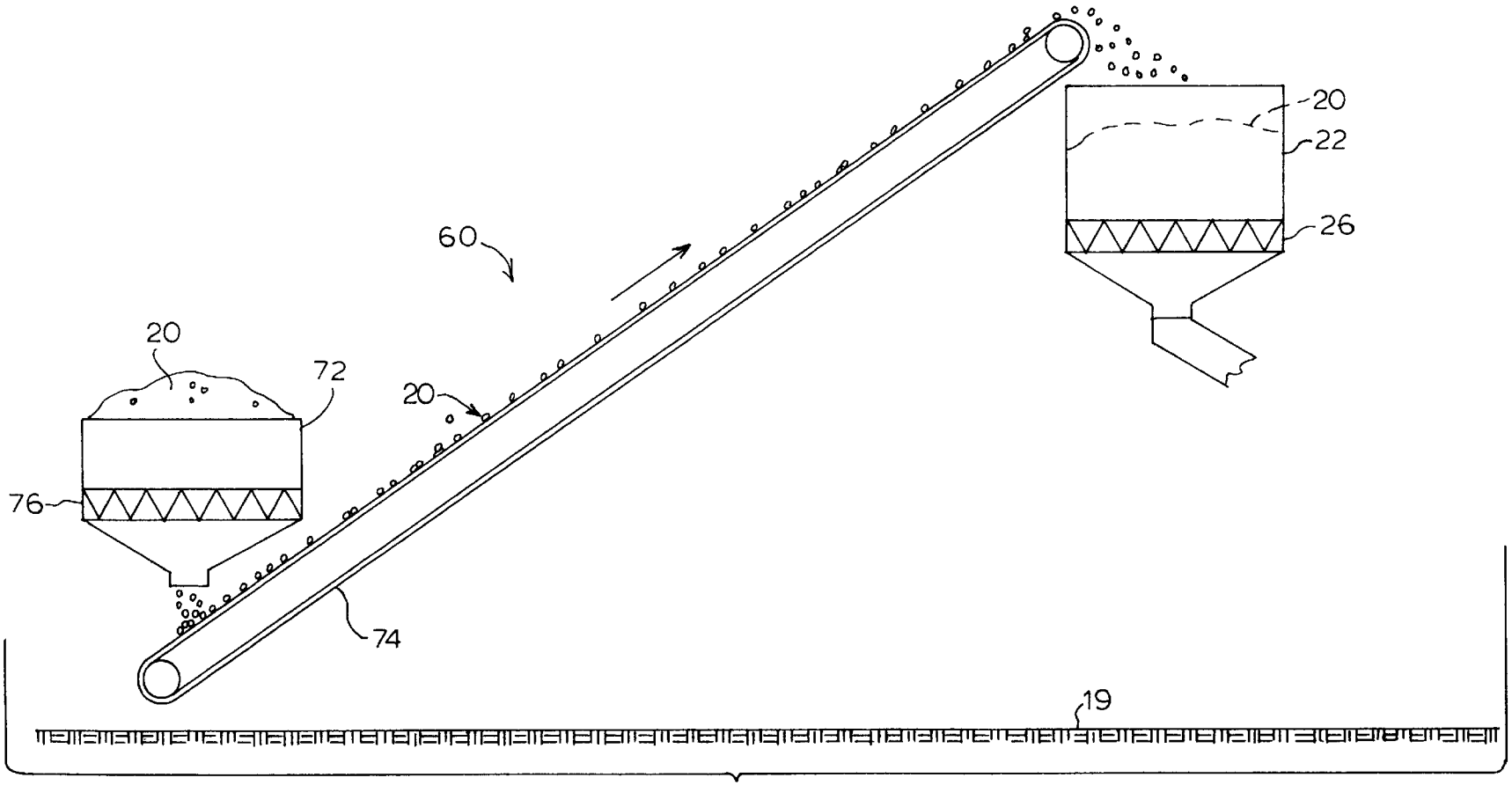
FIG. 3 is a schematic elevation view of a loading hopper feeder system and conveyor belt, used to feed soil to the kiln feeder system according to a second embodiment of the invention.

FIG. 3 illustrates in an alternative embodiment a conveyor belt loading system 60 which can be used to transport the untreated soil 20 to the kiln feeder hopper 22. Soil 20 is placed in the loading hopper 72 and fed to a conveyor 74 of the conveyor belt system 60 by a front end loader (not shown). Hopper 72 may also be equipped with a clod breaker 76.

Though not shown, it is recognized that in a variation of the illustrated FIG. 3 embodiment, loading hopper 72 is replaced with a feeding system which picks up soil directly from windrows, or alternatively, from a rotary plow breaking up in-place, undisturbed materials, e.g. along the bed of a roadway under construction. In this variation, a continuous, moving apparatus consisting of the FIG. 1 mobile soil conversion kiln and the FIG. 3 conveyor belt system capable of slowly progressing along the roadway is achieved.

Figure 4:
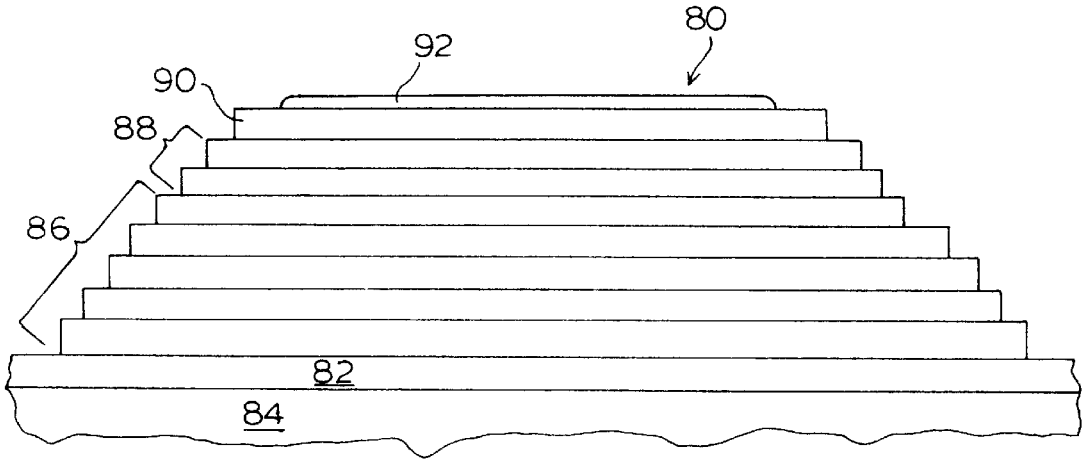
FIG. 4 is a diagram illustrating the components of a typical flexible pavement, the engineering properties of at least some of which components will desirably be different than in their natural state as achieved by the method of the invention.

FIG. 4 schematically illustrates the courses that could make up a typical flexible pavement 80. In this typical construction, a compacted subgrade 82 is first formed on the natural subgrade 84. The compacted subgrade 82 in turn receives various courses 86 of an improved subgrade material which in turn receives subbase courses 88. Base course 90 is placed on the uppermost of subbase courses 88 and the surface course of pavement 92 is placed on top of base course 90. Prime, tack and seal coatings are not shown for purposes of simplifying the drawing.

What should be recognized is that each of the soil materials 82, 86, 88 and 90 illustrated in FIG. 4, could beneficially use soils with different engineering properties. This can now be achieved by processing a quantity of soil from a single source according to the method of the invention, processing portions of the soil to achieve relatively high but different temperatures whereby to cause each portion to acquire its own set of engineering properties suited to its particular application. For example, the soil making up the lower level of the improved subgrade 86 can be processed by the invention process to reach a comparatively low temperature to improve its properties only to a minimum extent, such as reduced plasticity, prior to being placed and compacted. Each of the courses making up the upper layer material in layers 86 as well as the subbase course layers 88 may also be individually processed to reach ever increasing temperatures and thus causing each upper layer of material to have better engineering properties than those of the other courses. Additionally, the soil normally making up the natural subgrade can be processed according to the method of the invention to further enhance the construction.

The embodiment described above and illustrated in the accompanying drawings is a particular example and is not to be construed as a limitation of the scope and principles of the invention as more fully set forth in the appended claims.

I claim:

1. A method of converting a quantity of weak soil being unsuitable for use as a foundation material into a plurality of smaller quantities of soil each differing from said quantity of weak soil by being suitable as a foundation material, comprising the steps of:

(a) defining a first quantity of weak soil being unsuitable for use as a foundation material;

(b) separating a second quantity of weak soil from said first quantity of weak soil;

(c) disintegrating said second quantity of weak soil to ensure a loose particulate condition thereof, (d) moving said second quantity of weak soil while in a loose particulate condition through an angularly positionable, internally heated, rotating drum for a selected residence time to cause said second quantity of weak soil to be heated and thus achieve a first degree of strength so as to be suitable as a foundation material;

(e) separating a third quantity of weak soil from said first quantity of weak soil;

(f) disintegrating said third quantity of weak soil to ensure a loose particulate condition thereof; and (g) moving said third quantity of weak soil while in a loose particulate condition through said angularly positionable, internally heated, rotating drum for a selected time to cause said third quantity of weak soil to achieve a second degree of strength that is different than the first degree of strength achieved by said second quantity of soil and to be suitable as a foundation material.

2. A method of converting a quantity of weak soil into a plurality of smaller quantities as recited in claim 1, further comprising: maintaining said angularly positionable, internally heated, rotating drum at a substantially constant internal temperature; and adjusting the residence time of said weak soil in said drum by adjusting the angular position or the rotative speed of said drum.

3. A method of converting a quantity of weak soil in to a plurality of smaller quantities as recited in claim 1, wherein the step of moving said second quantity of weak soil further comprises: maintaining individual particles of said soil in said drum for a sufficient time that said particles of said soil attain a temperature in the range between 200° C.–2,000° C.

4. A method of converting a quantity of weak soil into a plurality of smaller quantities as recited in claim 3 wherein the individual particles of said third quantity of weak soil are maintained in said drum for a sufficient time to attain a greater temperature in the range between 200° C.–2,000° C. than the temperature attained by individual particles of said second quantity of weak soil.

5. A method of converting a quantity of weak soil into a plurality of smaller quantities as recited in claim 1, further comprising: separating a selected number of further quantities of weak soil from said first quantity of weak soil; disintegrating said third quantity of weak soil to ensure a loose, particulate condition thereof; moving each of said further quantities of weak soil while in loose particulate condition through said angularly positionable, internally heated, rotating drum to cause each of said further quantities of weak soil to be heated and to achieve a degree of strength that is different than the degree of strength achieved by others of said further quantities of soil and to be suitable as a foundation material.

6. A method of converting a quantity of weak soil into a plurality of smaller quantities as recited in claim 1, further comprising; depositing on a natural subgrade a selected first of said quantities of weak soil that has been moved through said drum so as to achieve a comparatively small degree of strength; and depositing subsequently on said first of said quantities of weak soil a selected second of said quantities of weak soil that has been moved through said drum so as to achieve a comparatively greater degree of strength than said first of said quantities.

7. A method of converting a quantity of weak soil into a plurality of smaller quantities as recited in claim 1, further comprising; adjusting sequentially the angular position of said angularly positionable drum so that each subsequent quantity of weak soil moves through said drum for a different residence time to achieve different degrees of strength than precedent quantities of weak soil.

8. A method of converting a quantity of weak soil into a plurality of smaller quantities as recited in claim 1, further comprising: depositing on a natural subgrade a selected first of said quantities of weak soil that has been moved through said drum so as to achieve a comparatively greater degree of strength; and depositing subsequently a selected second of said quantities of weak soil that has been moved through said drum so as to achieve a comparatively smaller degree of strength than said first of said quantities.

9. A method of converting a quantity of weak soil into a plurality of smaller quantities as recited in claim 7, wherein said step of adjusting sequentially the angular position of said drum further comprises reducing the angular position to increase said residence time and improve the strength of said quantity of weak soil.

10. Apparatus for processing a quantity of weak untreated soil unsuitable for use as a foundation material into a plurality of smaller quantities of soil each differing from said quantity of weak soil by being suitable as a foundation material, comprising:

(a) a cylindrical rotating kiln mounted on a trailer carriage, said rotating kiln having an outside wall mounted and encircled by a series of peripheral rims;

(b) a cylinder having an open internal chamber is mounted within said outside wall;

(c) a series of agitating fins are integral with said cylinder inner wall;

(d) an entry feeder hopper for containing untreated soil is supported at an untreated soil entrance into the kiln, said feeder hopper including an entry clod breaker located near a base of said feeder hopper for breaking up large pieces of untreated soil and a trough having walls that confine said untreated soil until reaching said discharge end of said rotating kiln;

(e) a series of drive rollers are mounted in a roller housing for rotation on said trailer carriage; said series of drive rollers are positioned for engagement with each of said series of peripheral rims;

(f) drive means coupled to said series of drive rollers for driving said series of drive rollers thereby transmitting rotary motion to each of said series of peripheral rims and said rotating kiln;

(g) speed control means coupled to each of said series of drive rollers for adjusting and controlling the rotational speed of said rotating kiln;

(h) a series of jacks are mounted on said trailer carriage on a bottom wall of said roller housing;

(i) angle control means coupled to each of said series of jacks for adjusting and controlling the angle of said rotating kiln to a desired angle from a horizontal position;

a plasma arc torch for use in supplying heat is mounted at a treated soil discharge end of said rotating kiln;

(k) utility means coupled to said plasma arc torch for adjusting and controlling temperatures within said rotating kiln;

(l) a discharge hopper positioned on said trailer carriage near said treated soil discharge end of said rotating kiln, said discharge hopper having an exit clod breaker for breaking up fused clods of treated soil; and (m) a side discharge system.

* * * * *